US006894651B2

(12) United States Patent
Yokochi et al.

(10) Patent No.: US 6,894,651 B2
(45) Date of Patent: May 17, 2005

(54) BUILT-IN ANTENNA, ELECTRONIC DEVICE USING THE SAME, METHOD OF MAKING THE SAME AND A METHOD OF INSTALLING THE SAME

(75) Inventors: Toshiyuki Yokochi, Tokyo (JP); Shinichi Takaba, Tokyo (JP); Takahiro Sugiyama, Tokyo (JP)

(73) Assignees: Hitachi Cable, Ltd., Tokyo (JP); Toshiba Corporation, Tokyo (JP)

( * ) Notice: Subject to any disclaimer, the term of this patent is extended or adjusted under 35 U.S.C. 154(b) by 0 days.

(21) Appl. No.: 10/730,277

(22) Filed: Dec. 9, 2003

(65) Prior Publication Data

US 2004/0164909 A1 Aug. 26, 2004

(30) Foreign Application Priority Data

Dec. 19, 2002 (JP) ..... 2002-368914

(51) Int. Cl.[7] ..... H01Q 1/24
(52) U.S. Cl. ..... 343/702; 343/718; 343/700 MS
(58) Field of Search ..... 343/702, 718, 343/872, 873, 700 MS

(56) References Cited

U.S. PATENT DOCUMENTS

| | | | | |
|---|---|---|---|---|
| 6,025,802 A | * | 2/2000 | Eggleston et al. | 343/700 MS |
| 6,218,991 B1 | * | 4/2001 | Sanad | 343/700 MS |
| 6,271,794 B1 | * | 8/2001 | Geeraert | 343/700 MS |

FOREIGN PATENT DOCUMENTS

| | | |
|---|---|---|
| EP | 1 001 486 A1 | 5/2000 |
| JP | 10-163748 | 6/1998 |
| JP | 10-190512 | 7/1998 |
| JP | 2000-196321 | 7/2000 |
| JP | 2001-185923 | 7/2001 |

* cited by examiner

*Primary Examiner*—Shih-Chao Chen
(74) *Attorney, Agent, or Firm*—McGinn & Gibb, PLLC

(57) ABSTRACT

A built-in antenna for being installed in a housing of insulating material has a metal plate that has a radiating portion and a feeder terminal. The radiating portion has a plurality of penetrating holes to be fitted to a plurality of protrusions provided on the housing side, and a plate spring that is formed extending from an edge of each of the plurality of penetrating holes to the center of the each of the plurality of penetrating holes.

12 Claims, 3 Drawing Sheets

BUILT-IN ANTENNA, ELECTRONIC DEVICE USING THE SAME, METHOD OF MAKING THE SAME AND A METHOD OF INSTALLING THE SAME

The present application is based on Japanese patent application No.2002-368914, the entire contents of which are incorporated herein by reference.

BACKGROUND OF THE INVENTION

1. Field of the Invention

This invention relates to a built-in antenna, an electronic device using the built-in antenna, a method of making the built-in antenna and a method of installing the built-in antenna.

2. Description of the Related Art

Built-in antennas are conventionally used in a mobile terminal device such as a cellular phone and a personal computer. The built-in antenna is fixed to a printed-circuit board, a cellular phone body cover etc. of the device. In general, the fixation is made such that a copper antenna plate (conductor plate) with a given shape and a positioning penetrating hole formed by punching is attached to the printed-circuit board or plastic molded body while fitting a positioning protrusion formed on the printed-circuit board or plastic molded body to the positioning penetrating hole, then fixing the antenna plate thereto by using adhesive tape or the like (first method, disclosed in, e.g., Japanese patent application laid-open No.10-163748 (page 2 and FIG. 2)), or by heating and melting the positioning protrusion (second method, disclosed in, e.g., Japanese patent application laid-open No.10-190512). Meanwhile, the antenna plate is electrically connected to the conductive pattern of printed-circuit board through a metallic contact pin.

However, in the first method, the step of attaching the adhesive tape to the antenna plate is additionally required and therefore it is not suitable for mass production. Further, after attaching the antenna plate to a molded body, the position of antenna plate cannot be changed to fit the shape of molded body. The adhesive tape itself is not suitable because it may affect the antenna characteristics.

In the second method, a special tool for heating and melting the protrusion requires a lot of skill to master. Further, after attaching the antenna plate to a molded body, the position of antenna plate cannot be changed to fit the shape of molded body.

SUMMARY OF THE INVENTION

It is an object of the invention to provide a built-in antenna that can be easily attached to a supporting member or housing to enhance the productivity.

It is a further object of the invention to provide an electronic device using the built-in antenna, a method of making the built-in antenna and a method of installing the built-in antenna.

According to the invention, a built-in antenna for being installed in a housing of insulating material, comprises:

a metal plate that includes a radiating portion and a feeder terminal;

wherein the radiating portion includes a plurality of penetrating holes to be fitted to a plurality of protrusions provided on the housing side, and a plate spring that is formed extending from an edge of each of the plurality of penetrating holes to the center of the each of the plurality of penetrating holes.

According to the invention, an electronic device, comprises:

a built-in antenna;

wherein the built-in antenna comprises a metal plate that includes a radiating portion and a feeder terminal, and the radiating portion includes a plurality of penetrating holes to be fitted to a plurality of protrusions provided on the housing of the electronic device, and a plate spring that is formed extending from an edge of each of the plurality of penetrating holes to the center of the each of the plurality of penetrating holes.

According to the invention, a method of making a built-in antenna for being installed in a housing of insulating material, comprises the step of:

punching a metal plate to form a radiating portion and a feeder terminal in the metal plate;

wherein the punching step is conducted such that the radiating portion includes a plurality of penetrating holes to be fitted to a plurality of protrusions provided on the housing side, and a plate spring that is formed extending from an edge of each of the plurality of penetrating holes to the center of the each of the plurality of penetrating holes.

According to the invention, a method of installing a built-in antenna comprising a metal plate that includes a radiating portion and a feeder terminal in a housing of insulating material, wherein the radiating portion includes a plurality of penetrating holes to be fitted to a plurality of protrusions provided on the housing side, and a plate spring that is formed extending from an edge of each of the plurality of penetrating holes to the center of the each of the plurality of penetrating holes, comprises the steps of:

positioning the plurality of penetrating holes to be fitted to the plurality of protrusions; and pressing the built-in antenna against the housing such that the plate spring is engaged with each of the plurality of protrusions.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

FIGS. 1A to 1F are plain views showing a method of making a built-in antenna in the preferred embodiment of the invention.

Figure 1A:
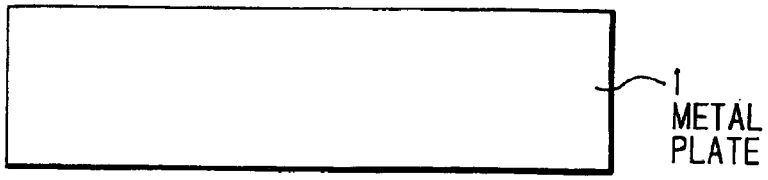
FIGS. 1A to 1F are plain views showing a method of making a built-in antenna in a preferred embodiment of the invention.
Figure 1B:
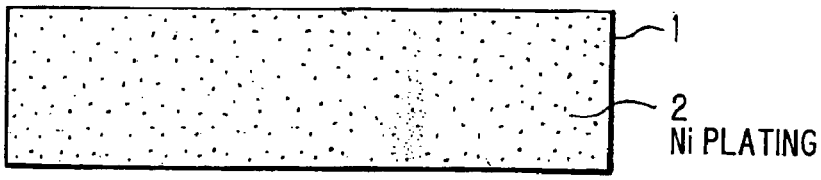

At first, as shown in FIG. 1A, a strip metal plate 1 (e.g., copper plate) is provided and then it is soaked in Ni plating solution, whereby it is, as shown in FIG. 1B, plated with Ni plating 2 on the entire surface for the purpose of corrosion protection.

Figure 1C:
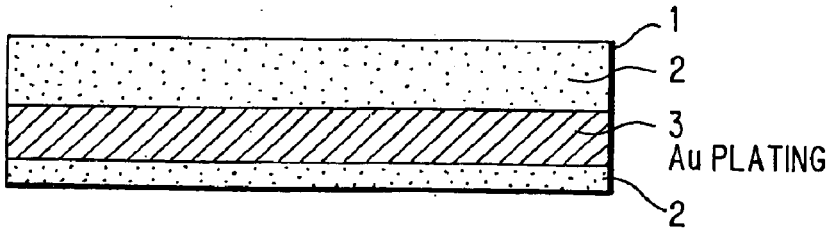

Then, a masking tape (not shown) is attached to a region except for part to be a stripe region on the surface of Ni plating 2, and the metal plate 1 is soaked in Au plating solution, whereby the stripe region is, as shown in FIG. 1C, plated with Au plating 3 to stabilize the conductivity of contact terminals (i.e., feeder terminal and ground terminal explained later).

Figure 1D:
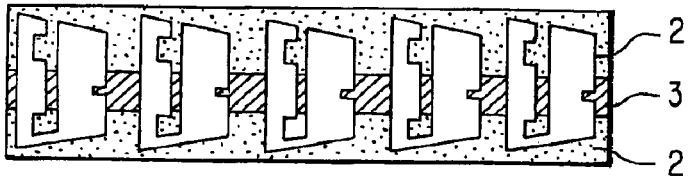
Figure 1E:
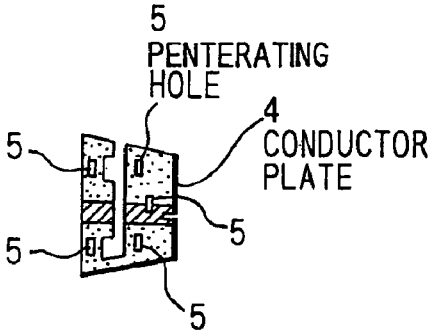

Then, the masking tape is removed from the metal plate 1 and, as shown in FIG. 1D, a plurality of portions (in FIG. 1D five portions but not limited to that number) of metal plate 1 are punched sequentially or simultaneously along the longitudinal direction. Thereby, a plurality of conductor plates 4 (though in FIG. 1E one of them) are obtained. In punching the metal plate 1, a plurality of penetrating holes 5 (in FIG. 1E five holes but not limited to that number) that corresponding protrusions are fitted through to fix the conductor plate 4 to a housing when the conductor plate 4 is housed in the housing and a plurality of plate springs 6 are made simultaneously. Meanwhile, FIG. 1D shows the metal plate 1 after punching.

Figure 1F:
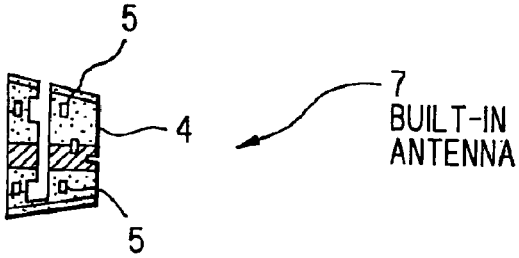

Then, as shown in FIG. 1F, the conductor plate 4 is folded (in FIG. 1F, both ends folded but not limited those portions) to fit the shape of a molded body (supporting board and cellular phone body cover described later). Also, the penetrating holes 5 and plate springs 6 are simultaneously folded at a predetermined angle on one side of the conductor plate 4. Thus, a built-in antenna 7 is formed. The shape of penetrating hole 5 (except for the shape of plate spring 6) is around rectangular in FIG. 1F, but it is not limited to that and may be circular, oval, elliptical or polygonal. However, it is required that the major axis of penetrating hole 5 is not half the wavelength of service radio wave to avoid the resonance of penetrating hole 5 itself.

The built-in antenna 7 is attached to the supporting board 18 (See FIG. 3B) or cellular phone body cover 21 (See FIG. 4), whereby the feeder terminal 8 and ground terminal 9 are electrically connected to a conductive pattern (not shown) formed on printed-circuit board.

Figure 2A:
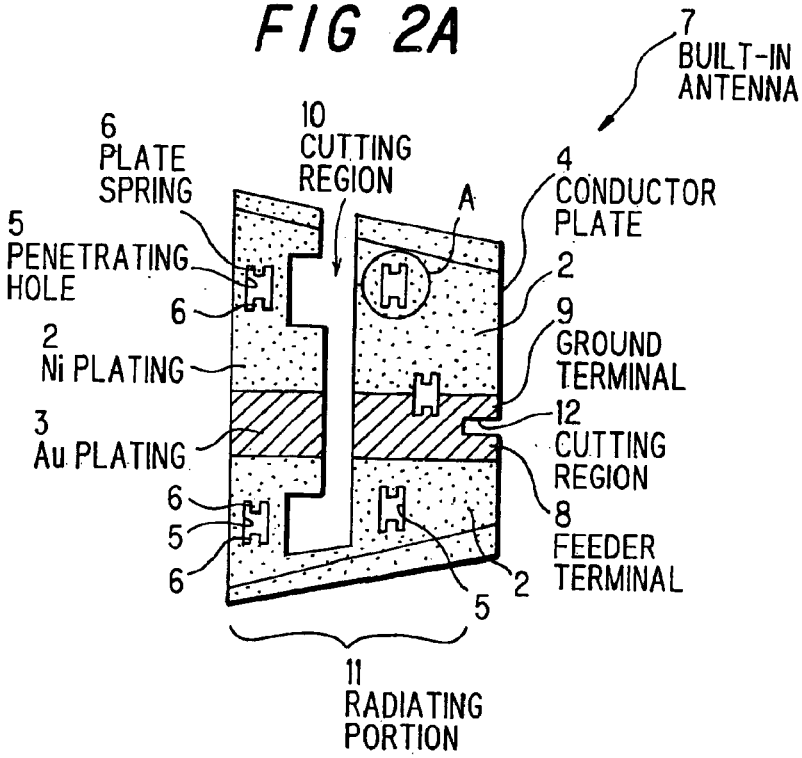
FIG. 2A is a plain view showing the built-in antenna in the preferred embodiment to be formed by using the method shown in FIGS. 1A to 1F.
Figure 2B:
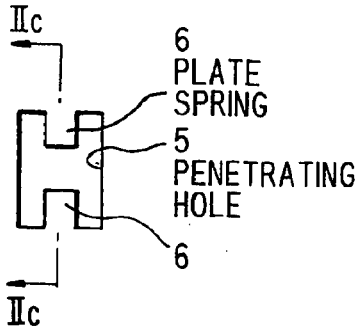
FIG. 2B is an enlarged plain view showing a penetrating hole in circle A in FIG. 2A.
Figure 2C:
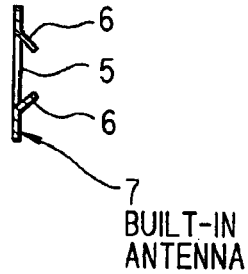
FIG. 2C is a cross sectional view cut along the line IIc—IIc in FIG. 2B.
Figure 2D:
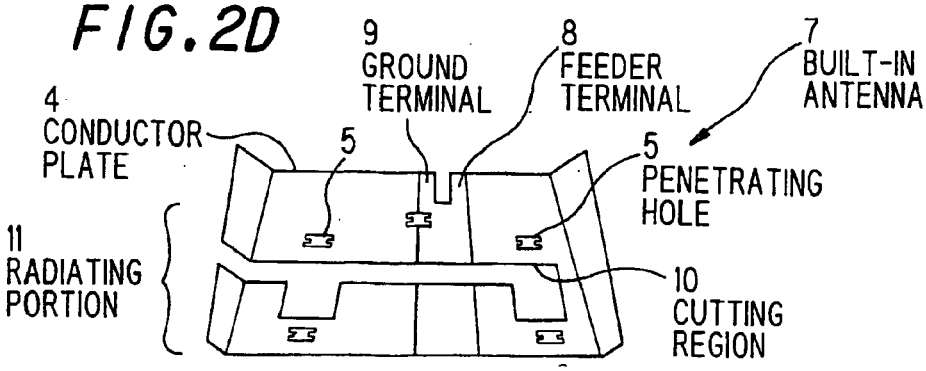
FIG. 2D is a perspective view showing the built-in antenna in FIG. 2A.

FIG. 2A is a plain view showing a built-in antenna 7 in the preferred embodiment to be formed by using the method shown in FIGS. 1A to 1F. FIG. 2B is an enlarged plain view showing the penetrating hole 5 in circle A in FIG. 2A. FIG. 2C is a cross sectional view cut along the line IIc—IIc in FIG. 2B. FIG. 2D is a perspective view showing the built-in antenna 7 in FIG. 2A.

The built-in antenna 7 is composed of a radiating portion 11 where a cutting portion 10 with at least a first resonance frequency $f_1$ and a second resonance frequency $f_2$ ($F_1<f_2$) is formed in the conductor plate 4, the feeder terminal 8 and ground terminal 9 formed on the conductor plate 4, and the plurality of penetrating holes 5 that the plurality of protrusions are fitted through to secure the conductor plate 4 to the supporting board 18 or cellular phone body cover 21.

In this embodiment, the feeder terminal 8 and ground terminal 9 are located at both sides of a cutting region 12 formed in the conductor plate 4. The cutting region 12 serves to provide a desired antenna characteristic with the built-in antenna 7. Although one feeder terminal 8 is shown in FIG. 2A, two or more feeder terminals may be formed. In this case, a plurality of feeder terminals can be separately used corresponding to frequencies of service radio wave. In FIG. 2A, the feeder terminal 8 is on the lower side and the ground terminal 9 is on the upper side, but they may be positioned inverted each other and positioned anywhere in the conductor plate 4, which is determined corresponding to the position of a contact pin 19, described later. Meanwhile, it is preferred that part of conductor plate 4 for disposing the feeder terminal 8 and ground terminal 9 is subjected to Au plating 3.

The conductor plate 4 may be of phosphor bronze, copper alloy, stainless steel etc. other than copper.

In this embodiment, the built-in antenna 7 is made by folding the conductor plate 4 obtained punching the metal plate 1 with Ni plating 2 and Au plating 3 and, therefore, the productivity can be enhanced and the dispersion of dimensional precision can be reduced. The conductor plate 4 has Ni plating 2 on both surfaces and, therefore, the corrosion of conductor plate 4 can be prevented and the diffusion of Au in Au plating 3 into-the metal plate 1 can be prevented.

Figure 3A:
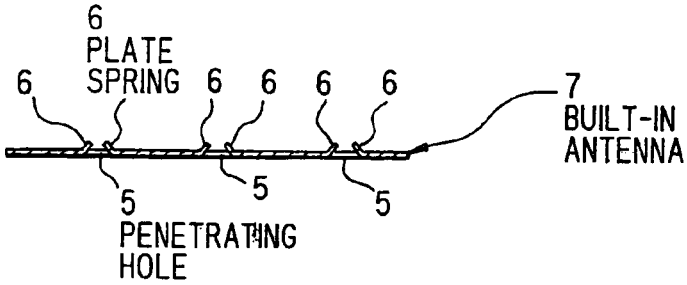
FIGS. 3A to 3C are cross sectional views showing a method of fixing the built-in antenna in the preferred embodiment of the invention.
Figure 3B:
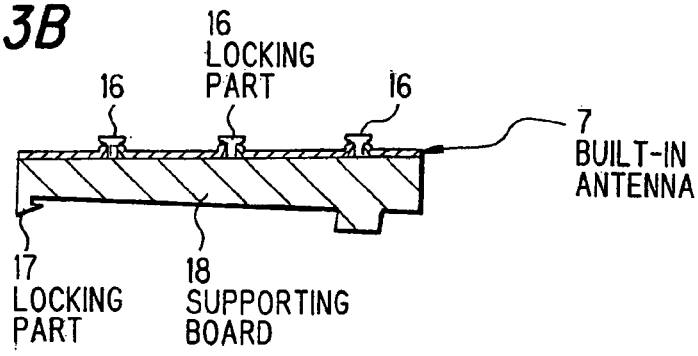
Figure 3C:
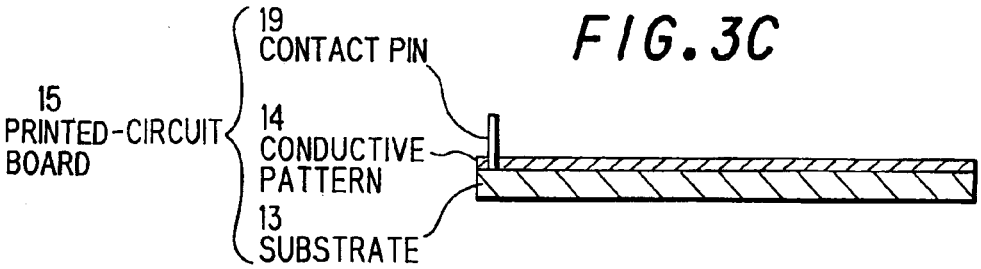

FIGS. 3A to 3C are cross sectional views showing a method of fixing the built-in antenna 7 in the preferred embodiment of the invention.

Shown in FIGS. 3A to 3C is a case that the built-in antenna 7 is attached to a printed-circuit board 15 which is composed of a substrate 13 disposed in cellular phone and a conductive pattern 14 formed on the substrate 13.

At first, the built-in antenna 7 with Au plating on the surface to face the supporting board 18 is provided (FIG. 3A).

Then, the supporting board 18 is provided that is composed of locking part 16 as a protrusion to be fitted to the penetrating hole 5 of built-in antenna 7 to fix the built-in antenna 7 and locking part 17 to fix the supporting board 18 to the printed-circuit board 15. As shown in FIG. 3B, the built-in antenna 7 is fixed to the supporting board 18 by fitting the locking part 16 of supporting board 18 to the penetrating hole 5.

The locking part 16 has a base portion (in FIG. 3A on the lower side) being secured to the supporting board 18 and a tip portion (in FIG. 3A on the upper side) having a T-shaped section with an outer diameter greater than that of the base portion. Thus, the plate spring 6 neighboring the penetrating hole 5 is engaged with the tip of locking part 16 to lock the built-in antenna 7 through the locking part 16.

The supporting board 18 is provided with a plurality of cutting regions or penetrating holes such that the contact pin 19, described later, is abutted on the feeder terminal 8 and ground terminal 9 of built-in antenna 7 while not contacting the supporting board 18.

It is preferred that the supporting board 18 has a size similar to that of built-in antenna 7 and a thickness according to bandwidth thereof and that it is of dielectric material with low specific gravity, good heat resistance and low dielectric loss. For example, it may be of ABS, ABS-PC etc. The supporting board 18 may be of any material other than ABS and ABS-PC if it can retain the form of built-in antenna 7.

Then, the printed-circuit board 15 is provided that is, as shown in FIG. 3C, composed of the substrate of insulating material, the conductive pattern 14 formed on the substrate 13 and the two contact pins 19 (for ground terminal and feeder terminal) having known telescopic double structure with a spring disposed inside.

Then, the supporting board 18 is pressed against the printed-circuit board 15 such that the tip of contact pins 19 standing on the printed-circuit board 15 abuts on the feeder terminal 8 and ground terminal 9. Thereby, the feeder terminal 8 and ground terminal 9 are electrically connected to the conductive pattern 14.

In this embodiment, the built-in antenna 7 is mechanically secured to the supporting board 18 such that the plate spring 6 neighboring the penetrating hole 5 is engaged with the tip of locking part 16 to lock the built-in antenna 7 on the housing side. Therefore, different from fixation by using adhesive tape etc., it is not subjected to influence of heating. The plate spring 6 is, as shown in FIG. 3A, inclined a predetermined angle from the plane of built-in antenna 7 and, therefore, the built-in antenna 7 becomes easy to fix to the protrusions (locking part 16, 20) when attaching the built-in antenna 7 to the housing, described later. Furthermore, the relative position between the penetrating hole 5 and the protrusion (locking part 16, 20) can be adjusted by changing the inclined angle of plate spring 6 when attaching the built-in antenna 7 and, therefore, the built-in antenna 7 can be securely fixed thereto.

Figure 4:
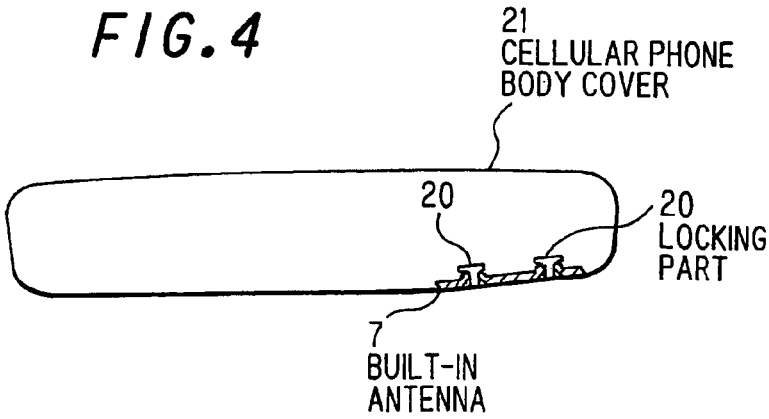
FIG. 4 is a schematic cross sectional view showing a method of fixing the built-in antenna in the other preferred embodiment of the invention.

FIG. 4 is a schematic cross sectional view showing a method of fixing the built-in antenna 7 in the other preferred embodiment of the invention.

In this embodiment, different from the embodiment shown in FIGS. 3A to 3C, the built-in antenna 7 is fixed directly to the housing of a cellular phone, a mobile terminal device etc.

The built-in antenna 7 is fixed to the cellular phone body cover 21 by fitting the penetrating holes 5 of built-in antenna 7 to a plurality of locking parts 20, which are formed inside the cellular phone body cover 21. The built-in antenna 7 has Au plating 3 on the opposite surface to the surface facing the cellular phone body cover 21 and the tip of contact pins 19 abuts on the surface of Au plating 3.

The cellular phone body cover 21 is preferably of dielectric material with low specific gravity, good heat resistance and low dielectric loss. For example, it may be of ABS, ABS-PC etc. The cellular phone body cover 21 may be of any material other than ABS and ABS-PC if it can retain the form of built-in antenna 7.

In this embodiment, the built-in antenna 7 is mechanically secured to the cellular phone body cover 21 such that the plate spring 6 neighboring the penetrating hole 5 is engaged with the tip of locking part 20 to lock the built-in antenna 7. Therefore, different from fixation by using adhesive tape etc., it is not subjected to influence of heating.

The invention is not limited to the above embodiments and the other various embodiments may be made in the invention.

For example, though in the above embodiment Ni plating 2 is used for corrosion protection, the other plating such as Ag plating may be used. The stripe Au plating 3 may be directly formed on the metal plate 1 without forming the plating for corrosion protection.

The feeder terminal 8 and ground terminal 9 may be formed to protrude from the plane of built-in antenna 7 while being bent U-shaped. By the springy force, they can be electrically connected to the conductive pattern 14 on the printed-circuit board 15.

Depending on the connection direction of feeder terminal 8 and ground terminal 9, the Au plating 3 may be formed on the upper surface and lower surface of metal plate 1 and may be in the form of other than stripe.

As described above, in the invention, the built-in antenna can be easily fixed to the supporting board or cellular phone body cover such that the plate spring neighboring the penetrating hole formed on the built-in antenna is engaged with the locking part of supporting board or cellular phone body cover to lock the built-in antenna. Therefore, the number of steps of attaching the built-in antenna can be reduced and the productivity can be thereby enhanced.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A built-in antenna for being installed in a housing of insulating material, comprising:

a metal plate that includes a radiating portion and a feeder terminal;

wherein the radiating portion includes a plurality of penetrating holes to be fitted to a plurality of protrusions provided on the housing side, and a plate spring that is formed extending from an edge of each of the plurality of penetrating holes to the center of the each of the plurality of penetrating holes.

2. The built-in antenna according to claim 1, wherein:

the plate spring is inclined a predetermined angle from the plane of the metal plate.

3. The built-in antenna according to claim 1, wherein:

the plurality of penetrating holes have a major axis with a length of less than half a wavelength of service radio wave.

4. An electronic device, comprising:

a built-in antenna;

wherein the built-in antenna comprises a metal plate that includes a radiating portion and a feeder terminal, and the radiating portion includes a plurality of penetrating holes to be fitted to a plurality of protrusions provided on the housing of the electronic device, and a plate spring that is formed extending from an edge of each of the plurality of penetrating holes to the center of the each of the plurality of penetrating holes.

5. The electronic device according to claim 4, wherein:

the plate spring is inclined a predetermined angle from the plane of the metal plate.

6. The electronic device according to claim 4, wherein:

the plurality of penetrating holes have a major axis with a length of less than half a wavelength of service radio wave.

7. A method of making a built-in antenna for being installed in a housing of insulating material, comprising the step of:

punching a metal plate to form a radiating portion and a feeder terminal in the metal plate;

wherein the punching step is conducted such that the radiating portion includes a plurality of penetrating holes to be fitted to a plurality of protrusions provided on the housing side, and a plate spring that is formed extending from an edge of each of the plurality of penetrating holes to the center of the each of the plurality of penetrating holes.

8. The method according to claim 7, wherein:

the plate spring is inclined a predetermined angle from the plane of the metal plate.

9. The method according to claim 7, wherein:

the plurality of penetrating holes have a major axis with a length of less than half a wavelength of service radio wave.

10. A method of installing a built-in antenna comprising a metal plate that includes a radiating portion and a feeder terminal in a housing of insulating material, wherein the radiating portion includes a plurality of penetrating holes to be fitted to a plurality of protrusions provided on the housing side, and a plate spring that is formed extending from an edge of each of the plurality of penetrating holes to the center of the each of the plurality of penetrating holes, comprising the steps of:

positioning the plurality of penetrating holes to be fitted to the plurality of protrusions; and pressing the built-in antenna against the housing such that the plate spring is engaged with each of the plurality of protrusions.

11. The method according to claim 10, wherein:

the plate spring is inclined a predetermined angle from the plane of the metal plate.

12. The method according to claim 10, wherein:

the plurality of penetrating holes have a major axis with a length of less than half a wavelength of service radio wave.

* * * * *